US011028847B2

(12) United States Patent
Ward

(10) Patent No.: US 11,028,847 B2
(45) Date of Patent: Jun. 8, 2021

(54) GEAR PUMP FOR VENTING TRAPPED VOLUME

(71) Applicant: Brose Fahrzeugteile GmbH & Co. Kommanditgesellschaft, Würzburg, Würzburg (DE)

(72) Inventor: Lyle Ward, Royal Oak, MI (US)

(73) Assignee: Brose Fahrzeugteile GmbH & Co. Kommanditgesellschaft, Würzburg, Würzburg (DE)

( * ) Notice: Subject to any disclaimer, the term of this patent is extended or adjusted under 35 U.S.C. 154(b) by 180 days.

(21) Appl. No.: 16/290,887

(22) Filed: Mar. 2, 2019

(65) Prior Publication Data

US 2020/0277952 A1 Sep. 3, 2020

(51) Int. Cl.
*F04C 2/08* (2006.01)
*F04C 2/14* (2006.01)

(52) U.S. Cl.
CPC ..... *F04C 2/088* (2013.01); *F04C 2/084* (2013.01); *F04C 2/14* (2013.01); *F04C 2240/20* (2013.01)

(58) Field of Classification Search
CPC ..... F04C 2/088
See application file for complete search history.

(56) References Cited

U.S. PATENT DOCUMENTS

| | | | | |
|---|---|---|---|---|
| 2,354,992 A * | 8/1944 | Gottlieb | ..... | F04C 2/088 418/196 |
| 4,017,224 A | 4/1977 | Jöns | | |
| 6,042,352 A | 3/2000 | Halter et al. | | |
| 2019/0024657 A1 | 1/2019 | George et al. | | |

FOREIGN PATENT DOCUMENTS

| | | | | |
|---|---|---|---|---|
| EP | 0455059 A1 * | 11/1991 | ..... | F04C 2/088 |
| EP | 3090181 A1 | 11/2016 | | |
| EP | 3172444 B1 | 9/2018 | | |
| EP | 3418571 A1 | 12/2018 | | |
| GB | 1149279 A | 4/1969 | | |
| GB | 1575328 A | 9/1980 | | |

* cited by examiner

*Primary Examiner* — Mary Davis
(74) *Attorney, Agent, or Firm* — Brooks Kushman, P.C.

(57) ABSTRACT

The external gear pump may include a housing, a first gear, a second gear, and an end plate. The housing may define an inlet and a discharge port. The first gear may include a first tooth and a second tooth. The second gear may be disposed within the housing and include a third tooth that engages the first tooth and the second tooth to form a pressure pocket. The end plate may be disposed within the housing. The first gear and the second gear may each be rotatably coupled to the end plate. The end plate may define a discharge channel and a bridge portion. The discharge channel may extend between the discharge port and the bridge portion. The bridge portion may define a relief portion and the relief portion may be configured such that fluid is communicated from the pressure pocket to the discharge port.

17 Claims, 4 Drawing Sheets

GEAR PUMP FOR VENTING TRAPPED VOLUME

TECHNICAL FIELD

The present disclosure relates to pumps, specifically to positive-displacement pumps for use in automotive vehicles.

BACKGROUND

A pump is a device that raises, transfers, delivers, or compresses fluids by suction or pressure of both. Vehicles may employ one or more pumps that provide fluid e.g., coolant or oil to a desired component within the vehicle. Mechanically driven pumps are generally coupled to and powered by internal combustion engine. Powering a pump by an electric motor decreases the load or work required from the engine, thus increasing the efficiency of the engine.

A positive displacement pump is a pump that displaces a known volume of fluid per unit cycle. One category of a positive displacement pump is a gear pump that includes two or more gears that are disposed within a pump housing. The gears may be rotatably coupled to an end plate that extends between an outer wall of the housing. The gears are arranged so that the teeth of each of the gears trap and displace fluid to create a low-pressure area, near an inlet of the pump, and a high-pressure area, near the discharge of the pump.

SUMMARY

According to one embodiment, an external gear pump is provided. The external gear pump may include a housing, a first gear, a second gear, and an end plate. The housing may include a peripheral wall forming an enclosure and defining an inlet and a discharge port. The first gear may include a first tooth and a second tooth. The second gear may be disposed within the housing and include a third tooth that engages the first tooth and the second tooth to form a pressure pocket. The end plate may be disposed within the housing. The first gear and the second gear may each be rotatably coupled to the end plate. The end plate may define a discharge channel and a bridge portion. The discharge channel may extend between the discharge port and the bridge portion. The bridge portion may define a relief portion and the relief portion may be configured such that fluid is communicated from the pressure pocket to the discharge port.

The relief portion may be at least partially defined by an axial surface by one of the teeth.

The relief portion may be comprised of a plurality of recessed finger cuts.

In one or more embodiments, when the first gear and the second gear are arranged in a first relative position, a first recessed finger cut of the plurality of recessed finger cuts may be partially eclipsed by the pressure pocket in an axial direction of the first and second gears.

The second gear may be provided with a fourth tooth, and when the first gear and the second gear are arranged in the first relative position, the third tooth, the fourth tooth, and the first tooth may define a second pressure pocket. A second recessed finger cut of the plurality of recessed finger cuts may at least partially eclipse the second pressure pocket in the axial direction of the first and second gears.

In one or more embodiments, when the first gear and the second gear are arranged in a second relative position, the first tooth, the second tooth, and the third tooth may define a third pressure pocket. A third recessed finger cut of the plurality of recessed finger cuts may at least partially eclipse the third pressure pocket in the axial direction of the first and second gears.

The second gear may be provided with a fifth tooth. When the first gear and the second gear are arranged in a second relative position, the second tooth, the third tooth, and the fifth tooth may define a fourth pressure pocket. A fourth finger cut of the plurality of recessed finger cuts may least partially eclipse the fourth pressure pocket in the axial direction of the first and second gears.

According to another embodiment, an external gear pump is provided. The external gear pump may include a peripheral wall that may form an enclosure and define an inlet and a discharge port. The gear pump may also include an end plate that may be disposed within the housing and the end plate may define a first recessed area. a second recessed area, and a bridge portion. The bridge portion may be disposed between a discharge channel and an inlet channel, that may each be defined by the second recessed area. The pump may include a first gear, that may include a first tooth and a second tooth, disposed within the first recessed area and configured to rotate about a first rotational axis. The pump may also include a second gear, disposed within the second recessed area and configured to rotate about a second rotational axis. The second gear may include a third tooth. When the first gear and the second gear are arranged in a first relative position, the third tooth may engage the first tooth and the second tooth to form a pressure pocket. The bridge may define a relief portion that may be configured to communicate fluid from the pressure pocket to the discharge port.

According to yet another embodiment, a gear pump is provided. The gear pump may include a housing that may include a peripheral wall forming an enclosure and defining an inlet and a discharge port. An end plate may be disposed within the housing and define a first recessed area, a second recessed area, and a bridge portion. The bridge portion may be disposed between a discharge channel and an inlet channel, each defined by the second recessed area. And the bridge portion may define a first recessed notch. The pump may also include a first gear, including a plurality of first gear teeth, disposed within the first recessed area and configured to rotate about a first rotational axis, and a second gear including a plurality of second gear teeth, disposed within the second recessed area and configured to rotate about a second rotational axis. When the first gear and the second gear are arranged in a first relative position, a first pair of teeth of the plurality of first gear teeth engages a first tooth of the plurality of second gear teeth to form a first pressure pocket. when the first gear and the second gear are arranged in a second relative position, a second pair of teeth of the plurality of first gear teeth engages a second tooth of the plurality of second gear teeth to form a second pressure pocket, and wherein the first recessed notch is positioned such that when the first gear and the second gear are arranged in either the first relative position or the second relative position, the first recessed notch is at least partially eclipsed by either the first pressure pocket or the second pressure pocket, respectively.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

The terms "first," "second," "third" etc. are merely exemplary and do not indicate a specific order. Rather, the terms "first," "second," "third" etc. are used to identify and distinguish one element from another.

The term "substantially" or "about" may be used herein to describe disclosed or claimed embodiments. The term "substantially" or "about" may modify a value or relative characteristic disclosed or claimed in the present disclosure. In such instances, "substantially" or "about" may signify that the value or relative characteristic it modifies is within ±0%, 0.1%, 0.5%, 1%, 2%, 3%, 4%, 5% or 10% of the value or relative characteristic.

Figure 1:
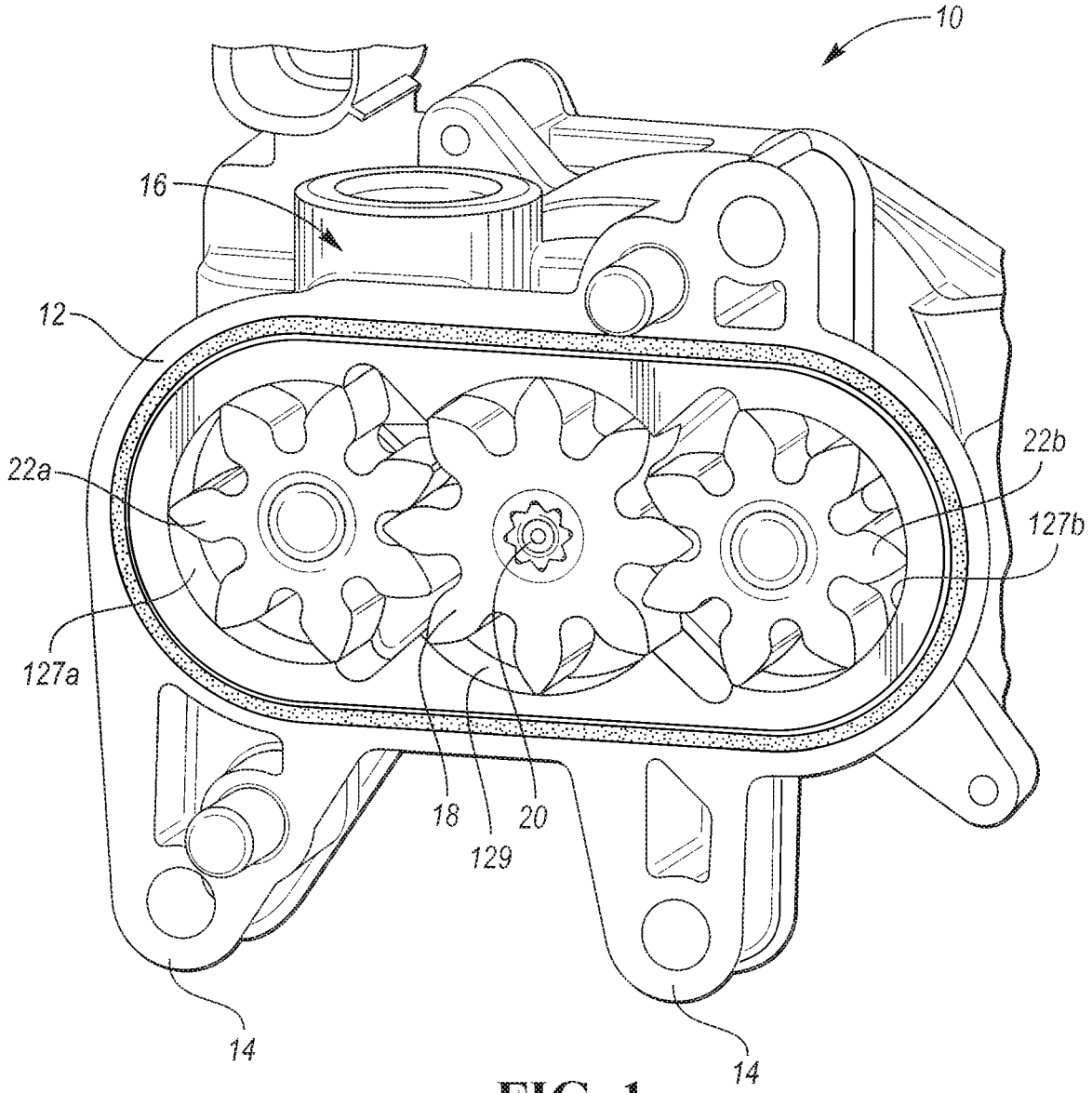
FIG. 1 is a perspective view of an exemplary pump.

FIG. 1 illustrates an exemplary pump assembly 10 that is provided with a housing 12. The cover of the pump 10 is hidden in this view so the internal portion of the pump is shown. The housing 12 includes an inlet 14 that may be disposed within a sump or reservoir (not illustrated) that holds oil or other fluid that may be carried to the discharge or outlet 16. Two or more gears may be disposed within the housing 12. One of the gears, such as a drive gear 18 may be rotated by a drive shaft 20. The drive gear 18 may engage one or more slave gears, such as 22*a* and 22*b*. The drive gear 18 and the slave gears 22*a* and 22*b* may be arranged so that the teeth of each of the gears trap and displace fluid e.g., oil, creating a low-pressure area, near the inlet of the pump, and a high-pressure area, near the discharge of the pump.

As fluid enters from the inlet 14 of the housing 12 the fluid is trapped between the teeth positioned nearest to the inlet and an inner surface e.g., 127*a* of the outer wall of the housing 12. Because the fluid is trapped between the teeth and the inner surface of the outer wall, the fluid is carried around the outside of the gears towards the discharge of the pump. The high-pressure area within the housing is formed by the fluid disposed between the discharge 16 of the pump and the gear teeth. The teeth of each of the gears 22*a*, 18, and 22*b* are sized and arranged to create a seal between the faces of each of the teeth that are engaged with one another. While some fluid may seep between the end plate and the gears, or the cover and the gears, or both, the seal prevents fluid from seeping from the high-pressure side to the lower pressure side.

Figure 2:
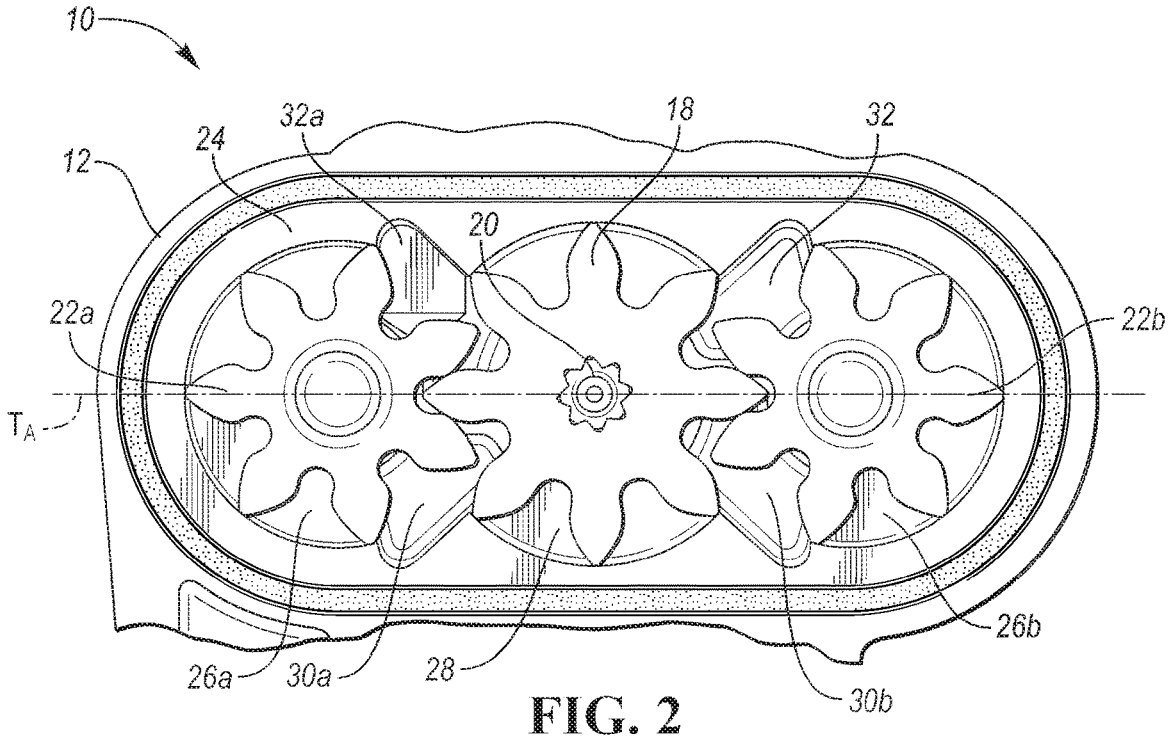
FIG. 2 (PRIOR ART)
FIG. 2 is a plan view of an interior portion a prior-art pump.

FIG. 2 illustrates the exemplary pump assembly 10 that includes a prior-art end plate 24. The prior-art end plate 24 defines a first recessed area 26*a*, that receives a first gear 22*a*, a second recessed area 28, that receives a second gear 18, and a third recessed area 26*b*, that receives a third gear 22*b*. The second gear 18 may be rotated by a drive shaft 20. The second gear 18 may be referred to as a drive gear and the first gear 22*a* and the third gear 22*b* may each be referred to as slave gears. The end plate 24 of the prior art defines a first outlet channel 32*a* and a second outlet channel 32*b* that are each disposed near the outlet of the pump assembly 10. The prior-art end plate 24 also defines a first inlet channel 30*a* and a second inlet channel 30*b* that are disposed near the inlet of the pump assembly 10. Fluid that is not discharged through the discharge outlet may collect within the first outlet channel 32*a* and the second outlet channel 32*b*. As fluid enters the pump assembly 10, a portion of the fluid may collect within the first inlet channel 30*a* and the second inlet channel 30*b*.

A transverse axis $T_A$ may extend between rotational axes of each of the gears. A portion of the pump 10 located above the transverse axis $T_A$ may be referred to as the outlet side or high-pressure side of the pump 10 and a portion of the pump 10 located below the transverse axis $T_A$ may be referred to as the inlet side or low-pressure side of the pump 10.

As will be described in greater detail below, the seal created by the arrangement of the teeth may prevent fluid seeping from the high-pressure side to the lower pressure side, the gear teeth may form pockets that may contain or trap fluid as the gears rotate. The rotation of the gears may compress the fluid and increase fluid pressure within the pocket, creating a "pressure pocket." The increase in pressure within the pressure pocket, may increase the torque required to rotate the gears. And this increase in torque may decrease the efficiency of the pump.

Figure 3:
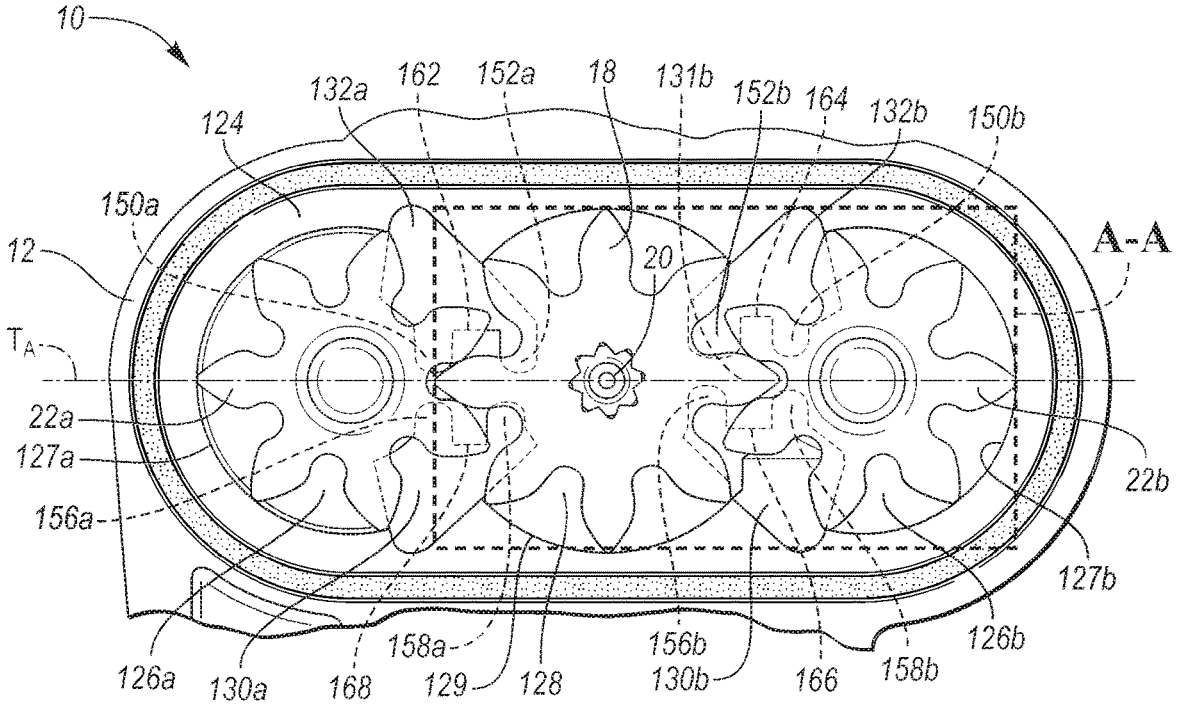
FIG. 3 is a plan view of an interior portion the exemplary pump.
Figure 4:
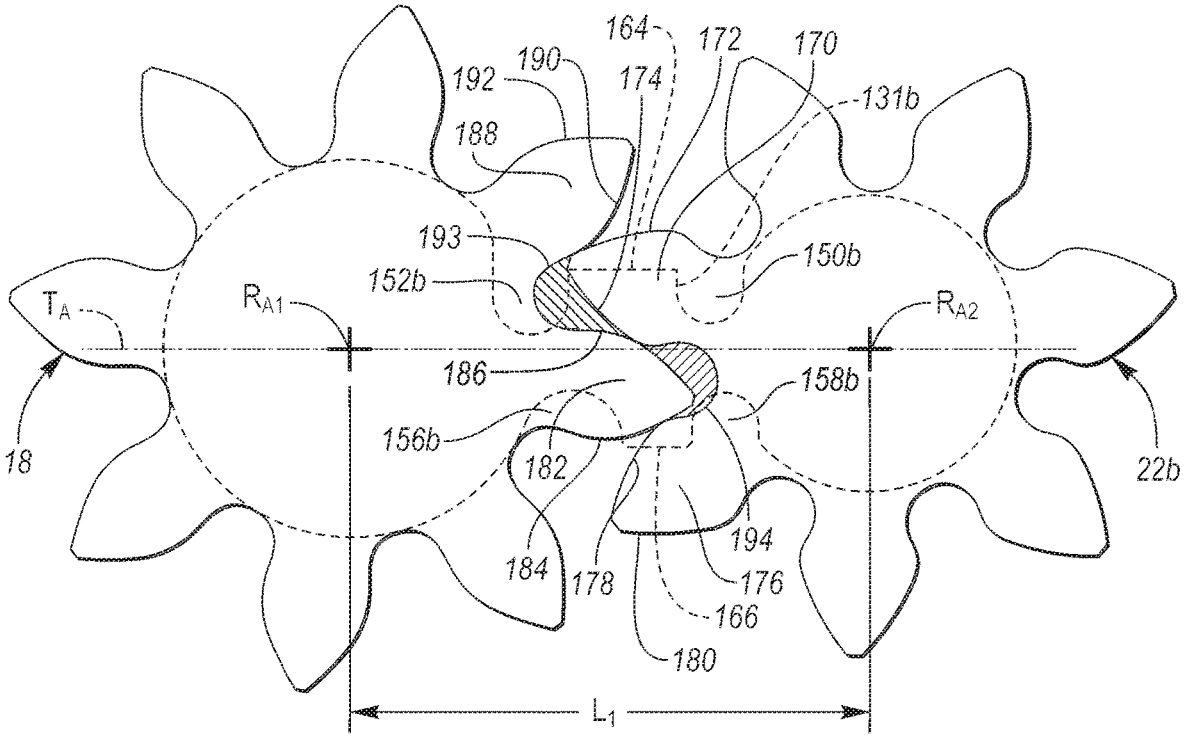
FIG. 4 is a schematic diagram of a set of gears of the exemplary pump in a first relative position.
Figure 5:
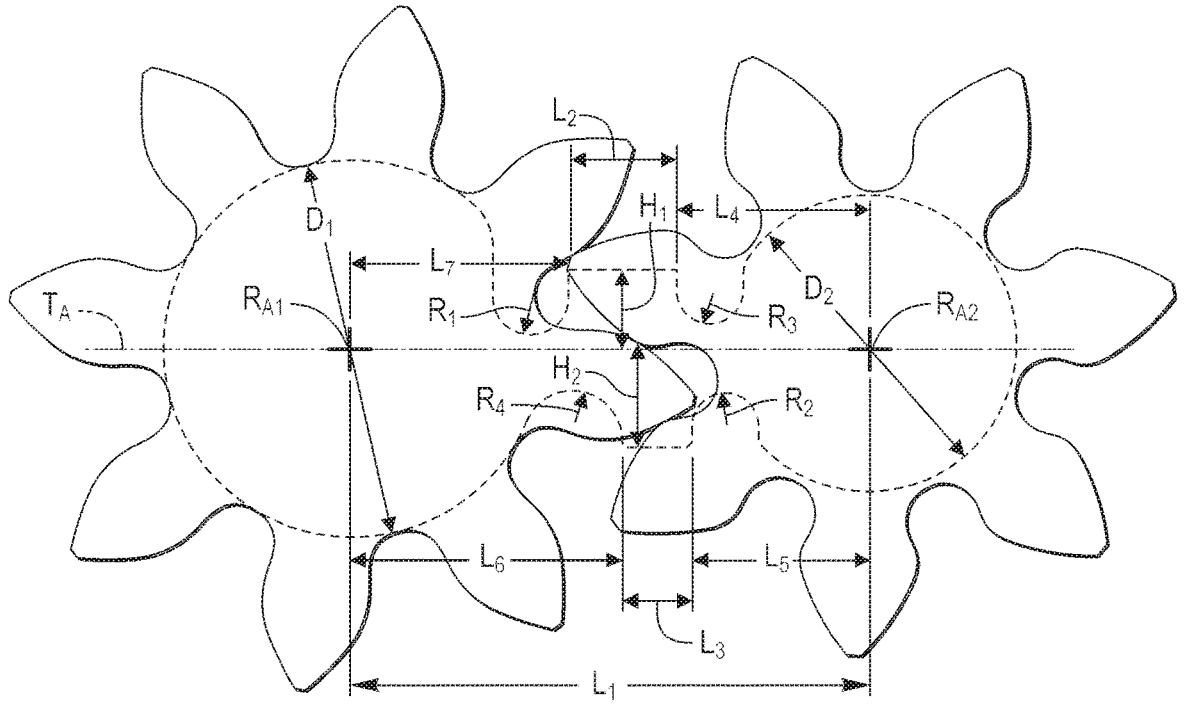
FIG. 5 is a schematic diagram of the set of gears of the exemplary pump and includes dimensions of the gear geometry.

FIG. 3 illustrates a pump assembly 10 according to one or more embodiments and FIG. 4 through FIG. 5 illustrate a portion of the pump assembly 10 within the dashed lines A-A in FIG. 3. The pump housing 12 includes an outer peripheral wall that may form an enclosure of the internal portion of the pump housing 12. The peripheral wall defines the inlet 14 and the discharge port 16 (FIG. 1).

Referring to FIGS. 3-5, the pump assembly 10 includes an end plate 124 that extends between the outer peripheral wall of the housing 12. The end plate 124 may define a first recessed area 128, that may receive a first gear 18, a second recessed area 126*b*, that may receive the second gear 22*b*, and a third recessed area 126*a*, that may receive the third gear 22*a*. The first gear 18 may be configured to rotate about a first rotational axis $R_{A1}$ and the second gear 22*b* may be configured to rotate about a first rotational axis $R_{A2}$. In one or more embodiments, the first gear 18 may be driven by the drive shaft 20. The drive shaft 20 may be coupled to an electric motor (not illustrated) that transfers rotational motion to the first gear 18. The drive gear may rotate in a clock-wise direction from the reader's perspective.

The arrangement and geometry of the first gear 18, the second gear 22*b*, and the portion of the end plate 124 adjacent to the first are symmetrically opposite e.g., mirrored, to the arrangement and geometry of the first gear 18, the third gear 22*a*, and the adjacent portion of the end plate 124. As such, the description of the first gear 18, the third gear 22*a*, and the adjacent portion of the end plate 124, illustrated in FIG. 4 through FIG. 6, need not be repeated to describe the arrangement and geometry of the first gear 18, the second gear 22*b*, and the adjacent portion of the end plate 124. Also, in one or more embodiments, the pump assembly 10 may not include the third gear 22*a*.

A first discharge channel 132*b*, may be defined by the end plate 124 and extend between the discharge port 16 and a first bridge portion 131*b*. A first inlet channel 130*b* may be defined by the end plate 124 and extend between an inlet port 14 and the first bridge portion 131*b*. The bridge portion 131*b* may define one or more relief portions e.g., 152*a*, 152*b*, 150*a*, 150*b*, 156*a*, 156*b*, 158*a*, and 158*b*, that may be configured to route fluid from a pressure pocket, formed by the gear teeth, to the discharge port 16.

In one or more embodiments, the bridge portions 131*a*, 131*b* may be referred to as a "bridge." Also, the relief portions may be referred to as a plurality of recessed finger cuts or as a plurality of recessed notches.

Referring specifically to FIG. 4 and FIG. 5, a schematic diagram illustrates the arrangement of the first gear 18 and the second gear 22*b*, in a first relative position. The bridge portion 131*b* and first gear diameters $D_1$ and second gear diameter $D_2$ are shown to illustrate their relative size and position with respect to the first gear 18 and the second gear 22*b*. The first gear 18 may include a first tooth 182 having a first face 184 and a second face 186. The first gear 18 may also include a second tooth 188 having a first face 190 and a second face 192. The second gear 22*b* may include third tooth 170 that may include a first face 172 and a second face 174. The second gear 22*b* may also include a fourth tooth 176 that may include a first face 178 and a second face 180.

When the first gear 18 and the second gear 22*b* are arranged in the first relative position, the first tooth 182 and the second tooth 188 of the first gear 18 may engage the third tooth 170 of the second gear 22*b* to form a first pressure pocket 193. The first recessed finger cut 152*b* defined by the bridge portion 131*b* is positioned so that the first pressure pocket 193 eclipses the first recessed finger cut 152*b*. The first recessed finger cut 152*b* may allow fluid to move from the first pressure pocket 193 to the outlet channel 132*b* (FIG. 3). Because the fluid moves from the first pressure pocket 193 to the outlet channel 132*b* (FIG. 3) the pressure within the first pressure pocket may be limited, thus reducing the torque required to rotate the first gear 18 and the second gear 22*b*.

The first pressure pocket may be bound by a first face 190 of the second tooth 188, the second face 186 of the first tooth, a root portion of the first gear 18 extending therebetween, and a second face 174 of the third tooth 170.

The second gear 22*b* may be provided with a fourth tooth 176 that engages the first tooth 182 of the first gear 18, when the first gear 18 and the second gear 22*b* are in the first relative position. The third tooth 170 and the fourth tooth 176 of the second gear 22*b* engages the first tooth 182 to form a second pressure pocket 194. The bridge portion 131*b* may define a second recessed finger cut 158*b*. The second recessed finger cut 158*b* may be positioned so that the second pressure pocket 194 is eclipses the second recessed finger cut 158*b*. The second recessed finger cut 158*b* may allow fluid to flow from the second pressure pocket 194 to the inlet cooling channel 130*b* (FIG. 3). The fluid received by the inlet cooling channel 130*b* from the second recessed finger cut may be carried by one of the teeth of the second gear 22*b* along an inner wall 127*b* of the second recessed area 126*b* to the outlet cooling channel 132*b* and the discharge outlet 16.

The fourth gear may include a first face 178 and a second face 180. The second pressure pocket may bound by a root portion of the second gear 22*b* that extends between the first face 178 of the fourth tooth 176 and the second face 174 of the third tooth 170.

The bridge portion 131*b* may include a third recessed finger cut 150*b* that may be connected to the first recessed finger cut 152*b* by an intermediate portion 164. The bridge portion may also include a fourth recessed finger cut 156*b* that is connected to the third recessed finger cut 158*b* by a second intermediate portion 166.

Figure 6:
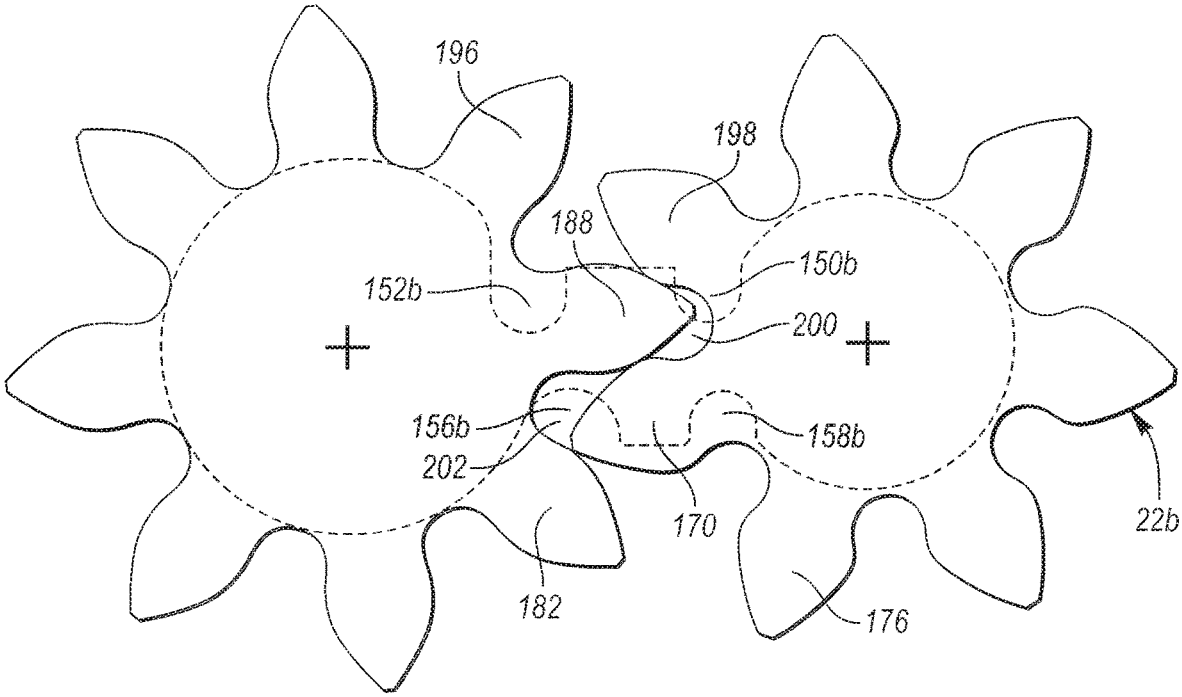
FIG. 6 is a schematic diagram of the set of gears of the exemplary pump in a second relative position.

Referring to FIG. 6, a schematic diagram illustrates the arrangement of the first gear 18 and the second gear 22*b*, in a second relative position. Here, the first gear 18 has rotated in a clockwise direction by a predetermined rotational angle from the position illustrated in FIG. 4 and FIG. 5. The rotation of the first gear 18 causes the second gear 22*b* to rotate in a counter-clockwise direction by a predetermined rotational angle, as shown in FIG. 6.

The second gear 22*b* may include a fifth tooth 198. The fifth tooth 198 and the third tooth 170 may each engage the second tooth 188 to form a third pressure pocket 200. When the gears 18, 22*b* are in the second relative position, the third pressure pocket 200 may substantially eclipse the third recessed finger cut 150*b*. The third recessed finger cut may provide the same function described above with respect to the first recessed finger cut 152*b*.

In the second relative position, the first tooth 182 and the second tooth 188 may engage the third tooth 170 to form a fourth pressure pocket 202. When the gears 18, 22*b* are in the second relative position, the fourth pressure pocket 202 may substantially eclipse the fourth recessed finger cut 156*b*. The fourth recessed finger cut 156*b* may provide the same function described above with respect to the second recessed finger cut 158*b*.

Figure 7:
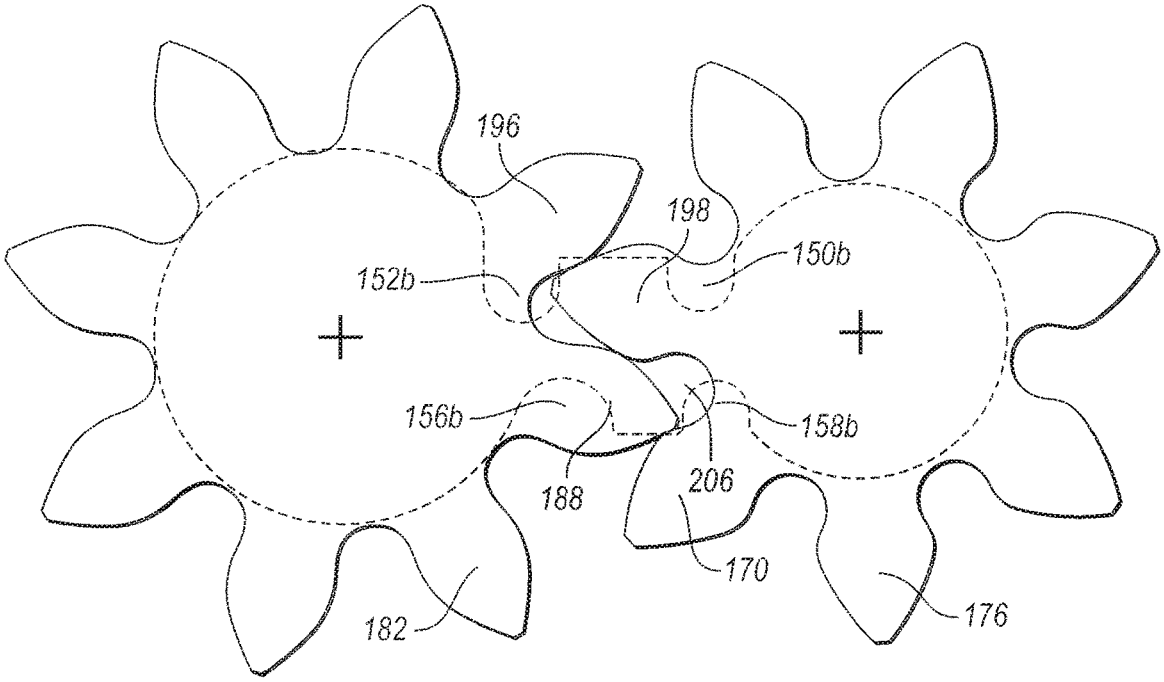
FIG. 7 is a schematic diagram of the set of gears of the exemplary pump in a third relative position.

Referring to FIG. 7, a schematic diagram illustrates the arrangement of the first gear 18 and the second gear 22*b*, in a third relative position. Here, the first gear 18 has rotated in a clockwise direction by a predetermined rotational angle from the position illustrated in FIG. 6. The rotation of the first gear 18 causes the second gear 22*b* to rotate in a counter-clockwise direction by a predetermined rotational angle, as shown in FIG. 7.

The first gear 18 may include a sixth tooth 196. The sixth tooth 196 and the second tooth 188 may engage the fifth tooth 198 of the second gear 22*b* to form a fifth pressure pocket 204. When the gears 18, 22*b* are in the third relative position, the fifth pressure pocket 204 may substantially eclipse the first recessed finger cut 152*b*. In the third relative position, the fifth tooth 198 and the third tooth 170 may engage the second tooth 188 to form a sixth pressure pocket 206. The sixth pressure pocket 206 may substantially eclipse the second recessed finger cut 158*b*.

Referring to FIG. 5, a schematic view of the first gear 18 and second gear 22*b* and a number of dimensions of the bridge portion 131*b* and relief portions are illustrated. The first gear 18 may define a first root diameter $D_1$ and the second gear 22*b* may define a second root diameter $D_2$ that may be less than the first root diameter $D_1$. The first rotational axis $R_{A1}$ of the first gear 18 and the second rotational axis $R_{A2}$ of the second gear 22*b* may be spaced apart by a first distance $L_1$.

The bridge portion 131*b* may be divided into an upper portion and a lower portion. The upper portion may be the portion that is disposed above the transverse axis $T_A$ and the lower portion of the bridge portion 131*b* may be disposed below the transverse axis $T_A$. The upper portion of the bridge portion 131*b* may define the first recessed finger cut 152*b* and the third recessed finger cut 150*b*. The lower portion of the bridge portion may define the second recessed finger cut 158*b* and the fourth recessed finger cut 156*b*. The first intermediary portion 164 may be spaced apart from the transverse axis $T_A$ by a first height $H_1$ and the second intermediary portion 166 may be spaced apart from the transverse axis $T_A$ by a first height $H_2$. In one or more embodiments, the second height $H_2$ may be greater than the first height $H_1$. The first intermediary portion 164 may define a second length $L_2$, measured from end points of the first recessed finger cut 152*b* and the third finger cut 150*b*. The second intermediary portion 166 may define a third length $L_3$, measured from end points of the fourth recessed finger cut 156*b* and the second finger cut 158*b*. In one or more embodiments, the second length $L_2$ may be greater than the third length $L_3$.

An end portion of the third recessed finger cut 150*b* may be spaced apart from the second rotational axis $R_{A2}$ by a fourth length $L_4$ and an end portion of the second recessed finger cut 158*b* may also be spaced apart from the second rotational axis $R_{A2}$ by a fifth length $L_5$. In one or more embodiments, the fourth length $L_4$ may be greater than the fifth length $L_5$. An end portion of the fourth recessed finger cut 156*b* may be spaced apart from the first rotational axis $R_{A1}$ by a sixth length $L_6$ and an end portion of the first recessed finger cut 152*b* may be spaced apart from the first rotational axis $R_{A1}$ by a seventh length $L_7$. In one or more embodiments, the sixth length $L_6$ may be less than the seventh length $L_7$.

The first recessed finger cut 152*b* may define a first radius $R_1$ and the third recessed finger cut 150*b* may define a third radius $R_3$. In one or more embodiments, the first radius $R_1$ may be larger than the third radius $R_3$. The radii of the first recessed finger cut 152*b* and the third recessed finger cut 150*b* may be sized to receive a sufficient volume of fluid to decrease the pressure of the respective pressure pockets. However, increasing the radii may beyond a predetermined threshold may decrease the amount of fluid moved by the gear teeth, thereby decreasing the efficiency of the pump assembly 10. The second recessed finger cut 158*b* may define a second radius $R_2$ and the fourth recessed finger cut 156*b* may define a fourth radius $R_4$. In one or more embodiments, the second radius $R_2$ may be greater than the fourth radius $R_4$.

In one or more embodiments, the end plate 124 may be integrally formed e.g., one piece, to the pump housing 12.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

PARTS LIST

The following is a list of reference numbers shown in the Figures. However, it should be understood that the use of these terms is for illustrative purposes only with respect to one embodiment. And, use of reference numbers correlating a certain term that is both illustrated in the Figures and present in the claims is not intended to limit the claims to only cover the illustrated embodiment.

pump assembly 10
pump housing 12
discharge outlet 16
first gear 18
drive shaft 20
prior—art end plate 24
recessed area 28
end plate 124
recessed area 128
first intermediary portion 164
second intermediary portion 166
third tooth 170
first face 172
second face 174
fourth tooth 176
first face 178
second face 180
first tooth 182
first face 184
second face 186
second tooth 188
first face 190
second face 192
first pressure pocket 193
second pressure pocket 194
sixth tooth 196
fifth tooth 198
third pressure pocket 200
fourth pressure pocket 202
fifth pressure pocket 204
sixth pressure pocket 206
second gear 22*b*
recessed area 26*a*
recessed area 26*b*
first inlet channel 30*a*
second inlet channel 30*b*
first outlet channel 32*a*
second outlet channel 32*b*
first recessed area 126*a*
second recessed area 126*b*
inner wall 127*b*
inlet channel 130*b*
first bridge portion 131*a*
second bridge portion 131*b*
outlet channel 132*b*
first recessed finger cut 152*b*
second finger cut 158*b*
third recessed finger cut 150*b*
fourth recessed finger cut 156*b*

What is claimed is:

1. An external gear pump comprising:

a housing including a peripheral wall forming an enclosure and defining an inlet and a discharge port;

a first gear, including a first tooth and a second tooth, disposed within the housing;

a second gear disposed within the housing and including a third tooth that engages the first tooth and the second tooth to form a pressure pocket; and an end plate disposed within the housing, wherein the first gear and the second gear are each rotatably coupled to the end plate, wherein the end plate defines a discharge channel and a bridge portion, wherein the discharge channel extends between the discharge port and the bridge portion, wherein the bridge portion defines a relief portion, and wherein the relief portion is configured such that fluid is communicated from the pressure pocket to the discharge port, wherein the relief portion is formed by a plurality of recessed finger cuts including a first recessed finger cut, defining a first radius, and a second recessed finger cut defining a second radius, wherein the second radius is less than the first radius.

2. The external gear pump of claim 1, wherein the relief portion is at least partially defined by an axial surface by one of the teeth.

3. The external gear pump of claim 2, wherein when the first gear and the second gear are arranged in a first relative position, the first recessed finger cut is at least partially eclipsed by the pressure pocket in an axial direction of the first and second gears.

4. The external gear pump of claim 3, wherein the second gear is provided with a fourth tooth, wherein when the first gear and the second gear are arranged in the first relative position, the third tooth, the fourth tooth, and the first tooth define a second pressure pocket, and the second recessed finger cut is at least partially eclipsed by the second pressure pocket in the axial direction of the first and second gears.

5. The external gear pump of claim 4, wherein when the first gear and the second gear are arranged in a second relative position, the first tooth, the second tooth, and the third tooth define a third pressure pocket, and wherein a third recessed finger cut of the plurality of recessed finger cuts is at least partially eclipsed by the third pressure pocket in the axial direction of the first and second gears.

6. The external gear pump of claim 5, wherein the second gear is provided with a fifth tooth, wherein when the first gear and the second gear are arranged in a second relative position, the second tooth, the third tooth, and the fifth tooth define a fourth pressure pocket, and wherein a fourth finger cut of the plurality of recessed finger cuts is at least partially eclipsed by the fourth pressure pocket in the axial direction of the first and second gears.

7. The external gear pump of claim 6, wherein the first gear is provided with a sixth tooth, wherein when the first gear and the second gear are arranged in a third relative position, the sixth tooth, the second tooth, and the fifth tooth define a fifth pressure pocket, and wherein the first recessed finger cut is at least partially eclipsed by the fifth pressure pocket in the axial direction of the first and second gears.

8. The external gear pump of claim 1, wherein the first gear is configured to rotate about a first rotational axis and the second gear is configured to rotate about a second rotational axis, and a transverse axis extends between the first rotational axis and the second rotational axis, and wherein the first recessed finger cut and the second recessed finger cut are each disposed on one side of the transverse axis.

9. The external gear pump of claim 8, wherein the first recessed finger cut and the second recessed finger cut are connected to one another by an intermediary portion and wherein the first rotational axis of the first gear is spaced apart from the intermediary portion by a first distance and wherein the second rotational axis of the second gear is spaced apart from the intermediary portion by a second distance that is less than the first distance.

10. An external gear pump comprising:

a housing including a peripheral wall forming an enclosure and defining an inlet and a discharge port;

an end plate disposed within the housing wherein the end plate defines a first recessed area, a second recessed area, a bridge disposed between a discharge channel and an inlet channel, each defined by the second recessed area, wherein the bridge defines a relief portion;

a first gear, including a first tooth and a second tooth, disposed within the first recessed area and configured to rotate about a first rotational axis; and a second gear, disposed within the second recessed area and configured to rotate about a second rotational axis, including a third tooth, wherein when the first gear and the second gear are arranged in a first relative position, the third tooth engages the first tooth and the second tooth to form a pressure pocket, and wherein the relief portion is configured to communicate fluid from the pressure pocket to the discharge port, wherein the end plate defines a transverse axis that extends between the first rotational axis and the second rotational axis, wherein the bridge includes a first portion, disposed on one side of the transverse axis, and a second portion, disposed on another side of the transverse axis, wherein the first portion defines a first recessed finger cut and a third recessed finger cut connected to one another by a first intermediary portion, having a first length, and the second portion defines a second recessed finger cut and a fourth recessed finger cut connected to one another by a second intermediary portion, having a second length less than the first length, and wherein the first recessed finger cut defines a first end point and the second recessed finger defines a second end point, wherein the first end point is spaced apart from the transverse axis by a first height and the second end point is spaced apart from the transverse axis by a second height that is greater than or equal to the first height.

11. The external gear pump of claim 10, wherein the first rotational axis of the first gear is spaced apart from the first intermediary portion by a first distance and wherein the second rotational axis of the second gear is spaced apart from the first intermediary portion by a second distance that is less than the first distance.

12. The external gear pump of claim 10, wherein the first recessed finger cut and the second recessed finger cut are each semi-circular and define a vertex, and wherein the vertex of the first finger cut is spaced apart from the first intermediary portion by a first depth and the vertex of the second finger cut is spaced apart from the second intermediary portion by a second depth less than the first depth.

13. An external gear pump comprising:

a housing including a peripheral wall forming an enclosure and defining an inlet and a discharge port;

an end plate disposed within the housing wherein the end plate defines a first recessed area, a second recessed area, a bridge portion disposed between a discharge channel and an inlet channel, each defined by the second recessed area, wherein the bridge portion defines a first recessed notch and a second recessed notch;

a first gear, including a plurality of first gear teeth, disposed within the first recessed area and configured to rotate about a first rotational axis; and a second gear, including a plurality of second gear teeth, disposed within the second recessed area and configured to rotate about a second rotational axis, wherein when the first gear and the second gear are arranged in a first relative position, a first pair of teeth of the plurality of first gear teeth engages a first tooth of the plurality of second gear teeth to form a first pressure pocket, and when the first gear and the second gear are arranged in a second relative position, a second pair of teeth of the plurality of first gear teeth engages a second tooth of the plurality of second gear teeth to form a second pressure pocket, and wherein the first recessed notch is positioned such that when the first gear and the second gear are arranged in either the first relative position or the second relative position, the first recessed notch is at least partially eclipsed by either the first pressure pocket or the second pressure pocket, respectively, wherein the first recessed notch defines a first radius and the second recessed notch defines a second radius that is less than the first radius.

14. The external gear pump of claim 13, wherein the first gear defines a first root diameter and the second gear defines a second root diameter that is less than the first root diameter, wherein a lateral position of the first recessed notch, with respect to the first rotational axis, and a lateral position of the second recessed notch, with respect to the second rotational axis, are based on the first root diameter and the second root diameter, respectively.

15. The external gear pump of claim 13, wherein the bridge portion defines a third recessed notch, wherein the third recessed notch is configured to communicate fluid from a third pressure pocket to the inlet channel.

16. The external gear pump of claim 15, wherein the bridge portion defines a fourth recessed notch and a transverse axis extending between the first rotational axis and the second rotational axis, wherein the fourth recessed notch and the second recessed notch are each disposed on a first side of the transverse axis and the first recessed notch and the third recessed notch are each disposed on a second side of the transverse axis.

17. The external gear pump of claim 16, wherein a first intermediary portion extends between the first recessed notch and the second recessed notch and a second intermediary portion extends between the third recessed notch and the fourth recessed notch, and the first recessed notch and the second recessed notch are each semi-circular and define a vertex, and wherein the vertex of the first notch is spaced apart from the first intermediary portion by a first depth and the vertex of the second notch is spaced apart from a second intermediary portion by a second depth less than the first depth.

* * * * *